US005078401A

United States Patent [19]

Fehrenbach et al.

[11] Patent Number: 5,078,401

[45] Date of Patent: Jan. 7, 1992

[54] LIGHT RESPONSIVE AUTOMATIC GOLF TEE

[76] Inventors: Donald E. Fehrenbach, 4200 M Rd., Escanaba, Mich. 49829; Allan Waeghe, 7710 Summit 19.55 Dr., Gladstone, Mich. 49837

[21] Appl. No.: 626,035

[22] Filed: Dec. 12, 1990

[51] Int. Cl.[5] ..... A63B 57/00

[52] U.S. Cl. ..... 273/201

[58] Field of Search ..... 273/201, 33

[56] References Cited

U.S. PATENT DOCUMENTS

| | | | |
|---|---|---|---|
| 2,295,599 | 9/1942 | Mozel | 273/201 |
| 3,778,067 | 12/1973 | Gentiluomo | 273/201 |
| 4,198,054 | 4/1980 | Stone | 273/201 |
| 4,355,811 | 10/1982 | Williams, Sr. | 273/201 |

*Primary Examiner*—Theatrice Brown

*Attorney, Agent, or Firm*—Richard C. Litman

[57] ABSTRACT

An automatic golf tee, after a ball is hit from it, lowers into the ground and reappears with a new ball ready to be hit. The tee is powered by an electric motor driving a vertical screw shaft onto which the tee is threaded. The tee cannot rotate; hence rotating the screw raises and lowers the tee. New balls are gravity fed to the tee at its lowermost position from an inclined ramp. The height to which the tee will rise is easily changed by moving an adjustable microswitch which, triggered by the rising tee, shuts off the motor. To start the tee downward after the ball is hit off of it, the tee is made hollow and a light-sensitive CdS cell is placed at the bottom. Uncovering the top of the tee lets light in, triggering the CdS cell to start the tee downward to pick up another ball. When the tee passes the feed ramp, a new ball rolls onto the tee, shutting off the light and stopping the downward travel.

6 Claims, 2 Drawing Sheets

LIGHT RESPONSIVE AUTOMATIC GOLF TEE

FIELD OF THE INVENTION

The present invention relates to automatic placement of golf balls on golf tees.

DESCRIPTION OF THE PRIOR ART

Various electromechanical devices have been developed for playing and practicing the game of golf. Because of the tedium of replacing a golf ball on a tee after a shot, various inventors have made apparatuses which automatically place a new golf ball onto a tee after a shot.

U.S. Pat. No. 4,934,697 of Shiau Ruey J. shows an "electric eye" (FIG. 9) in conjunction with a golf tee.

Atkinson et al., in U.S. Pat. No. 4,181,309 show electronic detection of a golf club swinging past a certain point. The detector triggers a vertically movable tee to shoot up through the ground to bring the ball into the path of the club.

Adam, in U.S. Pat. No. 4,741,537, shows a vertically movable tee operated by air pressure and the weight of the golf ball.

Stone, in U.S. Pat. No. 4,198,054 discloses a vertically movable tee with an underground inclined ramp which gravity feeds fresh balls to the tee when the tee is retracted into the ground to a lower position.

Gentiluomo, in U.S. Pat. No. 3,778,067 shows a vertically movable tee which is raised and lowered by an electric motor. There are two upper positions of the tee, for "fairway" shots and "tee" shots respectively. The one lower position of the tee is below ground level. In this lower position the tee is adjacent to the opening of a ramp which contains golf balls. The ramp is slanted slightly so that, when the tee is empty, a ball will roll down the ramp onto the tee. This ball is then raised for the next shot. (The tee is enclosed in a tube which prevents the balls from rolling off the other side of the tee when leaving the ramp.)

The vertical motion of the tee is stopped by two types of disclosed structure.

In the first embodiment there are three microswitches alongside the tee which are triggered at the lower and at the two upper positions as the tee moves vertically. These position-locating switches operate together with a light detector and a complex of relays and control circuits to move the tee from the lower to one of the two upper positions. The many switches increase the chances of breakdown.

The light detector is located inside the tee, which is hollow and contains a lens assembly inside, under the opening which is covered by the golf ball. The lens assembly sends light through a fiber-optic light guide to a photocell unit which is part of the control circuitry. This light guide is liable to breakage.

The light detector tells the circuitry whether the tee should be moved up (ball on tee blocking light) or down (ball off tee) or in other words, the direction in which the powering motor should turn. The microswitches then tell it when the tee has reached one of the end positions.

The second embodiment utilizes two stops which physically prevent the tee from moving past the lower or the higher of the two upper positions. The motor includes an clutch to prevent the motor from burning out when the tee is stopped. To achieve the second upper position, the vertically moving tee support structure includes a solenoid which pulls the tee down a slight amount. The stops are not readily adjustable.

In U.S. Pat. No. 3,549,152 Gentiluomo shows a similar design, which again includes an electric tee raising/-lowering motor and an electrooptical device (photocell) at the bottom of a hollow tee. (However, the light fibers are omitted here.) The same inclined ramp feed system is used. The control method is different, though.

Instead of discrete stops, an analog position sensor is used. The sensor sends a voltage to an "error detector" (comparator or difference indicator) in the control system. This sensor signal is proportional to the elevation of the tee. Simultaneously, the error detector receives another signal from one of three reference voltage sources. These reference voltages are adjustable by the user (potentiometers are used). Each reference voltage corresponds to one position. The motor responds to differences between the sensor voltage and reference voltage by moving the tee until the voltage difference is zero.

Thus, to achieve any position the control system must select one of the three reference voltages and connect it to the error detector. The selection is accomplished by switches and potentiometers. One switch is a relay which is tripped by the photocell to determine reference voltage polarity (corresponding to up or down motion of the tee); the other switch selects between the two upper positions.

Unlike the previous devices, this one allows a continuous range of upper and lower elevation positions. However, the reliance on potentiometers invites trouble from voltage drift, open circuits, and dirt. Also, the two upper position settings which are close together but also continuously adjustable appear to be unnecessarily complicated, as the continuous adjustment could easily change from one to another.

Moreover, the need for adjustment of the lower position is questionable, as a golf ball will roll onto the tee from the ramp without precise positioning. Apparently the adjustment is needed because of voltage drift which varies the position outside the workable range.

Gentiluomo discloses various tee-moving mechanism in his various patents and embodiments, such as belt drive, rack and pinion, and hydraulic drive. These mechanisms are complex and employ expensive, trouble-prone parts. The motion of the electric motor is indirect.

None of the above inventions and patents, taken either singly or in combination, is seen to describe the instant invention as claimed.

The prior art does not disclose an automatic tee apparatus which is simple and reliable in operation, inexpensive, and simple to maintain.

Accordingly, an object of the present invention is an apparatus for automatically placing golf balls on tees with improved simplicity, reliability, and expense.

Another object is an apparatus with a reduced number of parts.

A further object is an apparatus with direct drive.

These and other objects of the present invention will become readily apparent upon further review of the following specification and drawings.

SUMMARY OF THE INVENTION

The present invention comprises an automatic golf tee for repeatedly hitting golf balls without the need for manually replacing the ball after each shot. After a ball is hit from the tee of the present invention, the tee lowers into the ground and reappears in a few seconds with a new ball ready to be hit.

The tee is powered by an electric motor driving a helical screw shaft onto which the tee is threaded. The tee cannot rotate as it is held by a vertical bar. Hence, rotating the screw raises and lowers the tee.

Replacement balls are gravity fed to the tee at its lowermost position from an inclined ramp.

The height to which the tee will rise is easily changed by moving an adjustable microswitch which, triggered by the rising tee, shuts off the motor. To start the tee downward after the ball is hit off of it, the tee is made hollow and a light-sensitive CdS cell is placed at the bottom. Uncovering the top of the tee lets light in, triggering the CdS cell to start the tee downward to pick up another ball. When the tee passes the feed ramp, a new ball rolls onto the tee, shutting off the light and stopping the downward travel.

FIGS. *2a* and *2b* are detail views with partial cross section of the tee and the carrier in which it rides.

Figure 3:
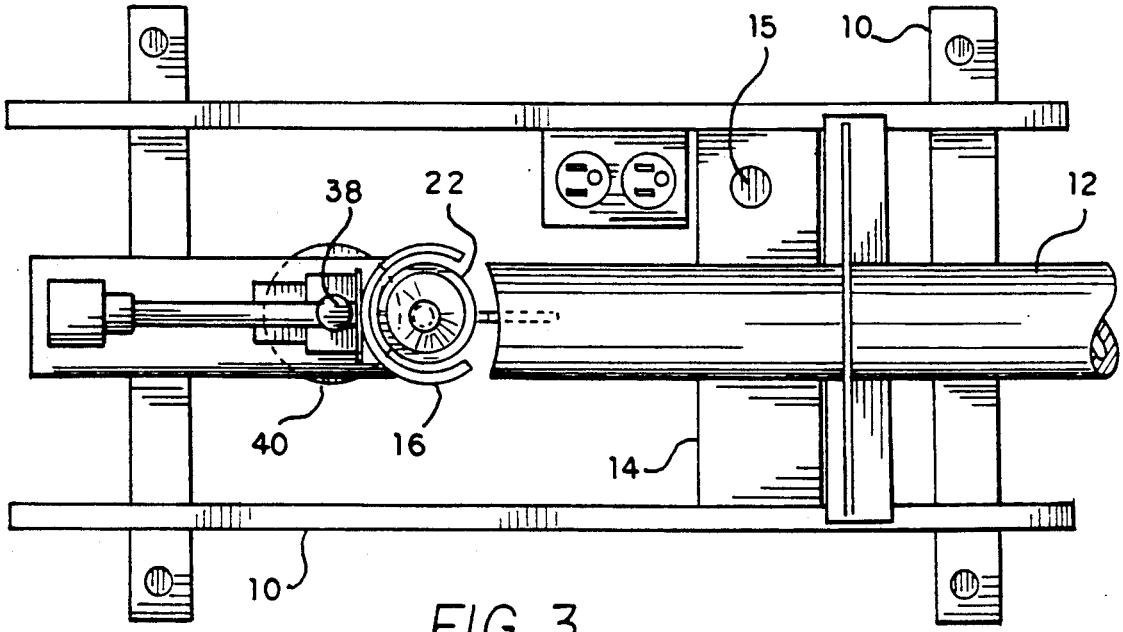

FIG. 3 is a plan view of the invention.

Figure 4:
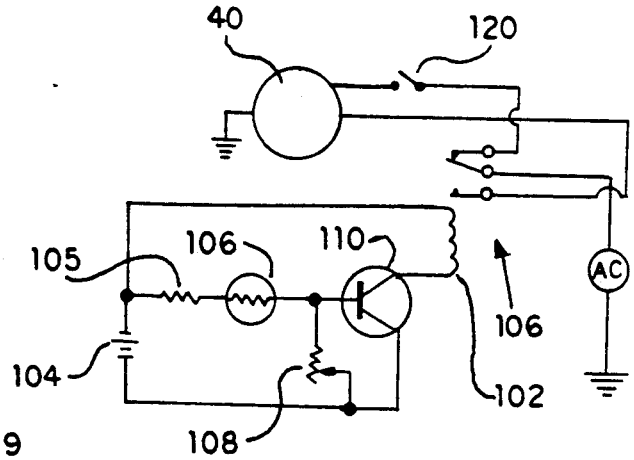
Figure 2B:
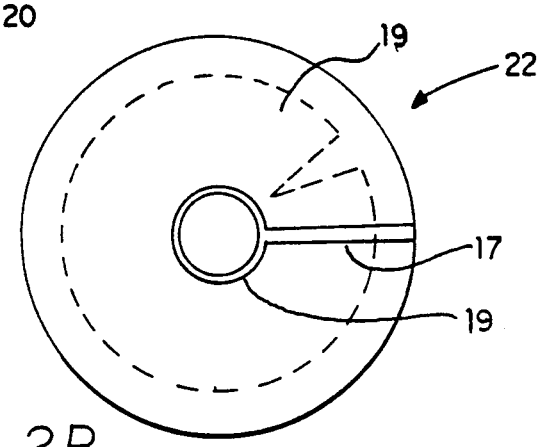

FIG. 4 is a schematic of the control circuit.

Similar reference characters denote corresponding features consistently throughout the attached drawings.

DETAILED DESCRIPTION OF THE PREFERRED EMBODIMENT

Figure 1:
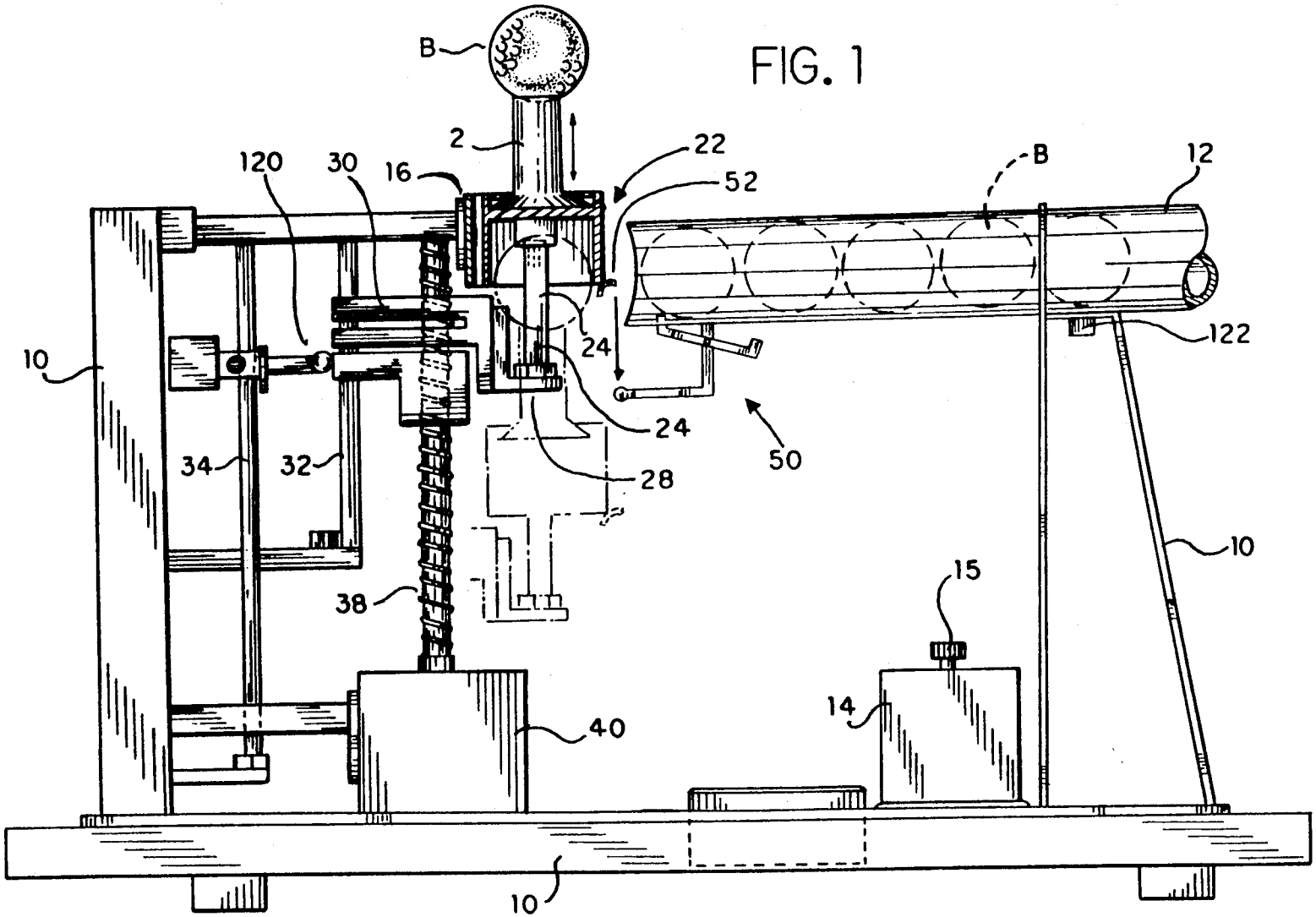
FIG. 1 is an elevation view of the invention showing the tee in the raised position. The lower position of the tee is shown in phantom view.
Figure 2A:
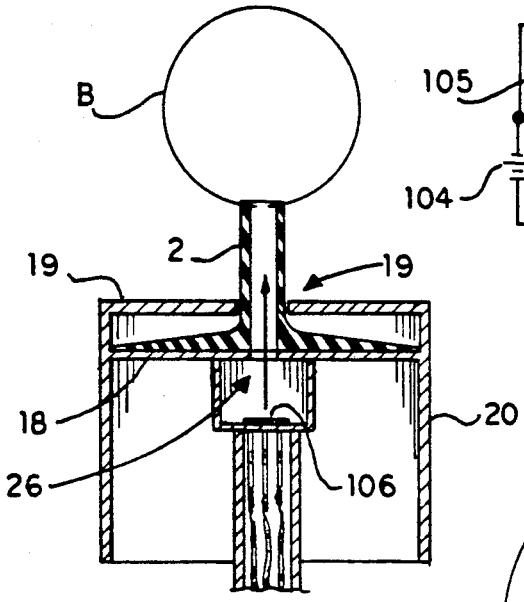

An overview of the invention is shown in FIG. 1. A frame 10 holds the various parts in alignment. Golf balls B are fed to the tee 2 along a ramp 12. The tee 2 rides in a cradle 22, which in turn rides on a post 24. The post is threaded onto a bracket 28 which is in turn attached to a rider 30. The rider 30 has a threaded hole through which is threaded a helically threaded vertical shaft 38 which is fixed to the armature of a motor 40.

The rider 30 cannot rotate because it slides on a stanchion 32 fixed to the frame 10. Thus, if the motor 40 armature rotates the tee 2 will rise or fall depending upon the rotation sense.

The cradle 22 includes (as better seen in FIGS. *2a* and *2b*) a cylindrical side member 20 and two parallel and horizontal plates disposed inside the cylinder 20. The tee 2 is an ordinary rubber type having a widened base, which is held in the cradle between these horizontal plates, labeled 18 and 19. The top plate 19 includes a central hole through which the stem of the tee 2 protrudes.

For inserting the tee 2 into the cavity between the plates 18 and 19, a slot 17 is cut into the top plate 19. When a radial wedge is removed from the base of the tee 2, the tee can be turned through the slot 17 to the position shown. Thus, tees can be easily replaced when they deteriorate from use.

The bottom plate 18 also has a hole 26 through the center for admitting light to a light-sensitive electrooptical device 106, or photocell, which controls the vertical motions of the tee. Preferably, the device is a CdS cell. The function of the cell is explained below in the electronics explanation.

A second stanchion 34 locates a microswitch 120 which slides and locks at various positions along the stanchion 34. The microswitch is the type which changes its state only during contact. It is normally closed; it opens only during the time it is in contact with the rider 30.

In FIG. 3 is seen the frame 10, electrical control box 14, ramp 12, a cuff 16. The cuff 16 prevents balls B from rolling off the tee 2 when exiting from the ramp 12.

Referring now to FIG. 4, the control circuit for the tee is shown schematically. Relay 100 controls power to the motor 40 which is an AC bidirectional motor (line voltage). When the relay 100 is relaxed (coil 102 not powered) then AC voltage passes through the relay 100 to the terminal of the motor 40 which will power it to drive the tee upward. When the relay coil 102 is energized the AC is switched to power the motor to bring the tee down.

The relay coil is energized by the battery 104 acting through the emitter-collector circuit of the transistor 110. The transistor 110 is switched by the light-sensitive CdS cell which is physically located at the bottom of the tee. The cell 106 is protected by a resistor 105 of about one kilohm, and variably biased by a variable resistor or potentiometer 108 of about 50 kilohms maximum. Changing the resistance 108 varies the light sensitivity of the CdS cell circuit, and allows for the use of the device under various light conditions.

This adaptability to ambient light intensity is a very useful improvement. The automatic golf tee can be used in bright sunlight, at night, or indoors. The CdS cell in the circuit disclosed has been found to be easily adjusted to any light conditions. The adjustment is easily made. The knob 15 on the control box 14 may be the adjustment, for example.

The CdS cell is a resistor which is virtually an open circuit in darkness, but has only about 100 ohms resistance in bright light. When the cell 106 is in darkness (ball on tee), no current flows in the base and the transistor 110 is off. The coil 102 is unpowered, the relay 100 is relaxed, and the relay sends voltage to the motor 40 to bring the tee up.

At a certain point the rising rider will hit the microswitch 120, opening it and interrupting the power. The motor will then stop. The system remains in this state until the ball is hit off of the tee.

When the ball is hit and light shines on the CdS cell, the relay will flip and the motor will be powered to bring the tee 2 down. The motor will continue to run until the tee passes the ramp 12 and the next ball B rolls onto the tee 2, shutting off the light. The CdS cell resistance again jumps up, the relay relaxes, and the motor voltage flips again, driving the tee 2 upward until the microswitch 120 is again opened.

The ramp 12 includes a ball release mechanism 50 for releasing one ball to the tee. The mechanism is tripped by a catch 52 on the cradle 22.

To prevent the tee from going too far downward, a safety switch can be built in. For example, a switch to the power may open whenever there are fewer than 5 balls in the ramp 12. This switch could be, as one example, a microswitch 122 with a movable lever arm protruding through the bottom wall of the ramp 12 in the position where the fifth ball in the ramp comes to rest.

Another sort of safety switch that might be employed is a normally-closed push-button (momentary contact) switch mounted on the top of the motor 40 with the button directed upward (not shown). This switch would open when the rider 30 descended onto it.

The basic idea of the circuit above could easily be adapted to a DC motor with a different relay. Instead of single throw, double pole relay, one could use a double pole, double throw relay. The plus and minus terminals of the DC motor would be wired to the two poles on either side of the relay in opposite polarity, so that throwing the switch to one set of poles or the other would reverse the polarity and thus the direction of motor rotation.

It is to be understood that the present invention is not limited to the sole embodiment described above, but encompasses any and all embodiments within the scope of the following claims.

We claim:

1. An automatic ball replacement apparatus comprising:

a frame;

a vertically movable ball holder, said ball holder movable between an upper stationary position and a lower ball receiving position, said ball holder including a hollow interior containing a light sensitive electrical element, said ball holder including a circular mouth adapted to support a ball thereupon and to shut light from said hollow interior when the ball is supported thereupon;

a mechanism adapted to vertically move said ball holder, said mechanism including an electric motor and a vertical shaft attached to said frame to provide vertical motion of said ball holder, said motor being electrically connected to said light sensitive element and having rotation means for rotation in a first direction and a second direction, said first direction corresponding to upward motion of said ball holder, and said second direction corresponding to downward motion of said ball holder, said first direction of rotation resulting from a ball being placed on said ball holder to shield light from said light sensitive element, and said second direction of rotation resulting from a ball being removed from said ball holder to permit light to contact said light sensitive element, relay means adapted to control electric current between said light sensitive element and said motor, said relay means being adapted to make electrical connection between said light sensitive element and said motor only when a signal voltage is present, said light sensitive electrical element being adapted together with voltage amplifying means to impress said signal voltage onto said relay means upon admission of ambient light to said light sensitive element;

means for varying the sensitivity of said light sensitive element to ambient light;

a vertically adjustable momentary contact switch for determining said upper stationary position, said switch adapted to open when said ball holder occupies said upper stationary position to thereby reactivate said motor, and ball dispensing means for automatically placing a ball onto said mouth of said ball holder when said ball holder is in said lower ball receiving position; whereby if there is ambient light and when a ball is removed from said ball holder when in said upper position, said ball holder will automatically move to said ball receiving position to receive a ball and thereupon rise to said upper stationary position.

2. An apparatus as in claim 1 wherein said rotation means is a vertically aligned armature, and attachment means disposed between said armature and said shaft, said attachment means preventing relative rotation of said armature and said shaft.

3. An apparatus as in claim 1 wherein said ball holder further comprises a replaceable tee and a tee carrier adapted to removably hold said tee.

4. An apparatus as in claim 3 wherein:

said tee is flexible and includes a hollow stem and a base; and said tee carrier includes a horizontal bottom plate, a top plate parallel to said bottom plate, a generally circular opening in said top plate, and a slot extending from said opening for passing said base of said tee through said opening of said top plate.

5. An apparatus as in claim 1 wherein said amplifying means includes a transistor and a variable resistor, said variable resistor and said light sensitive electrical element together adapted to bias the base of said transistor for varying the sensitivity of said apparatus to ambient light by changing the resistance value of said variable resistor.

6. An apparatus as in claim 1 wherein said light sensitive electrical element is a CdS cell.

* * * * *